US006840183B2

(12) United States Patent
Wark

(10) Patent No.: US 6,840,183 B2
(45) Date of Patent: Jan. 11, 2005

(54) DIFFUSER INSERT FOR COAL FIRED BURNERS

(76) Inventor: Rickey E. Wark, 4 Watermark Way, The Woodlands, TX (US) 77381

( * ) Notice: Subject to any disclaimer, the term of this patent is extended or adjusted under 35 U.S.C. 154(b) by 0 days.

(21) Appl. No.: 10/459,986

(22) Filed: Jun. 12, 2003

(65) Prior Publication Data

US 2003/0209470 A1 Nov. 13, 2003

Related U.S. Application Data

(63) Continuation-in-part of application No. 09/901,207, filed on Jul. 9, 2001, now Pat. No. 6,588,598, which is a continuation-in-part of application No. 09/440,250, filed on Nov. 15, 1999, now Pat. No. 6,257,415.

(51) Int. Cl.[7] ..... F23K 1/00; F23K 3/02

(52) U.S. Cl. ..... 110/106; 110/104 R; 110/263

(58) Field of Search ..... 110/106, 263, 110/261, 347, 104 R, 104 B; 239/406

(56) References Cited

U.S. PATENT DOCUMENTS

| | | | | |
|---|---|---|---|---|
| 391,873 | A | | 10/1888 | Allington |
| 1,120,534 | A | | 12/1914 | Pruden |
| 1,315,719 | A | | 9/1919 | Grindle |
| 1,318,375 | A | | 10/1919 | Golf |
| 1,814,395 | A | | 7/1931 | Lykken |
| 2,184,297 | A | | 12/1939 | Grindle |
| 2,510,240 | A | | 6/1950 | Mayo |
| 2,667,969 | A | | 2/1954 | Bishop et al. |
| 2,868,462 | A | | 1/1959 | Bogot et al. |
| 2,988,220 | A | | 6/1961 | Gracza |
| 3,630,458 | A | | 12/1971 | Smiley |
| 4,243,183 | A | | 1/1981 | Eirich et al. |
| 4,256,044 | A | | 3/1981 | Burton |
| 4,471,703 | A | * | 9/1984 | Vatsky et al. ..... 110/263 |
| 4,592,516 | A | | 6/1986 | Tschantz |
| 4,634,054 | A | | 1/1987 | Grusha |
| 4,818,376 | A | | 4/1989 | Tanaka et al. |
| 5,215,259 | A | | 6/1993 | Wark |
| 5,463,967 | A | | 11/1995 | Gielow et al. |
| 5,533,629 | A | | 7/1996 | Ito et al. |
| 5,645,381 | A | | 7/1997 | Guidetti et al. |
| 5,697,306 | A | * | 12/1997 | LaRue et al. ..... 110/261 |
| 5,758,605 | A | * | 6/1998 | Calkins ..... 122/31.1 |
| 5,937,770 | A | * | 8/1999 | Kobayashi et al. ..... 110/263 |
| 6,318,559 | B2 | | 11/2001 | Cordonnier et al. |
| 6,439,136 | B1 | | 8/2002 | Mann et al. |

FOREIGN PATENT DOCUMENTS

| | | |
|---|---|---|
| AU | 247350 | 10/1963 |
| DE | 1158898 | 12/1963 |
| FR | 735373 | 11/1932 |
| FR | 822453 | 12/1937 |
| GB | 279767 | 10/1927 |
| JP | 63-259316 | 10/1988 |

OTHER PUBLICATIONS

Schmidt, S., "'Balancing' Pulverized Coal and Air Flows for Improved Boiler Performance," ABB C–E Services, Inc. Publication, Oct. 1998, pp. 1–10.

Naumov et al., Derwent Publication #1989–014878, Abstract Pub. SU–1407582A, Jul. 1988.

* cited by examiner

*Primary Examiner*—Kenneth Rinehart
(74) *Attorney, Agent, or Firm*—Young & Basile, P.C.

(57) ABSTRACT

A diffuser for a pulverized coal delivery pipe near an elbow connection to a burner nozzle. A diffuser structure is located in the pipe adjacent the elbow outlet, with both radial and axial diffuser elements for diffusing radial and axial components of coal concentrations between the elbow and the nozzle. In a preferred form, the elbow is formed with an access hatch aligned with the pipe at the elbow outlet, and the diffuser structure is formed as a drop-in insert that can be installed and accessed through the hatch. The diffuser has a venturi inlet that produces an initial diffusion effect with minimal pressure drop before the coal flow reaches the radial and axial collision-style diffuser elements.

8 Claims, 4 Drawing Sheets

DIFFUSER INSERT FOR COAL FIRED BURNERS

RELATED APPLICATIONS

This application is a continuation in part of application Ser. No. 09/901,207 filed Jul. 9, 2001 now U.S. Pat. No. 6,588,598, which is a continuation-in-part Ser. No. 09/440,250 filed Nov. 15, 1999, of U.S. Pat. No. 6,257,415 filed Jul. 10, 2001.

FIELD OF THE INVENTION

The present invention is in the field of diffuser structure used in a coal classifying and delivery flow path between a pulverizer and a combustion chamber in a coal-fired power plant.

BACKGROUND OF THE INVENTION

In the field of coal pulverizing mills there are generally two types of mills, characterized by the manner in which the pulverized coal is delivered from the mills to a combustion chamber: "suction" mills using exhauster fans to pull the pulverized coal fines from the mill through discharge pipes; and, fanless "pressurized" mills that typically entrain the pulverized coal fines in a stream of pressurized air originating at the mill.

Each type of mill presents its own problems with respect to the goal of supplying an even, balanced flow of coal fines through multiple pipes to multiple burners in the combustion chamber. In suction mills, for example, the exhauster fan tends to throw coal in an unbalanced stream, with heavier particles settling out to one side of the flow through the pipe and lighter fines on the other. In pressurized mills without exhauster fans, distribution problems tend to occur as a result of the varying lengths of discharge pipe leading from the top of the classifier to the various burners around the combustion chamber. Shorter lengths of discharge pipe generally run rich with air (but tend to run lean in coal), while longer lengths of pipe tend to run lean in air (but tend to run rich in coal).

Rich/lean imbalances among the various burners in the combustion chamber produce the usual problems: loss on ignition (LOI) contamination of the ash byproduct; NOX formation; fireball distortion and waterwall erosion; and others known to those skilled in the art.

One common technique for trying to balance coal flow in pipes of different length is known as "clean air flow testing", in which orifice plate restrictors are placed in the shorter pipes to try to balance air flow with respect to the longer (slower, lower volume) pipes in an air-only test procedure. The problem with clean air flow testing is that, having balanced air flow in a theoretical test, the introduction of coal fines produces fundamentally different results than the air-only testing would indicate, and the orifice plates worsen distribution problems among and within the pipes. As a result, further efforts have attempted on-line adjustable orificing with coal flow present, with similarly disappointing results.

Another approach to balancing coal flow among multiple pipes has been to use a "dynamic" classifier. Dynamic classifiers power-rotate an array of vanes in the classifier cone to decelerate larger particles of coal and encourage lighter fines to travel up and out the classifier into the discharge pipes. It has been found, however, that the use of dynamic classifiers still results in significant differences in distribution among the pipes.

U.S. Pat. No. 6,257,415 and a continuation-in-part thereof (co-pending application Ser. No. 09/901,207) disclose diffuser elements and structures for achieving uniform distribution of coal fines among the individual pipe outlets at the top of a multi-outlet classifier and at multi-outlet branch structures in the network of delivery pipes between the classifier and the combustion chamber; and, a single-pipe diffusion structure for rapid diffusion within the pipe over a short distance. Some of the structures disclosed show a combination of vertical diffuser bars and horizontal diffuser elements, which together diffuse both axial and radial components of uneven flow distributions through a plenum or pipe while minimizing pressure drop.

Installing the above diffuser structure in existing coal delivery pipes can be a difficult job, especially for relatively small diameter single-pipe applications. The pipe sections are welded and/or otherwise sealed to keep the pressurized coal/air flow contained. Securing the diffuser structure to the interior wall surfaces of the pipe requires working in a fairly tight space, often at a distance from the actual point of access to the pipe interior since it is undesirable to open up a pipe section other than at its joint with the next section. The installation becomes more difficult for diffuser structures comprising different types of elements that cooperate with one another in vertically and radially spaced and stacked arrays.

Just as it is desirable to provide equal volumetric balance of coal and air among the burner nozzles directing coal from the pipes into the combustion chamber, it is also important to maintain an even distribution of coal from the exit of each nozzle. Burner nozzles are often provided with internal baffles or "splitter plates" for this purpose.

However, it is common to find sharply-angled turns or elbows in the delivery pipe shortly before the nozzles, the elbows serving to align the outlet end of the pipe with the burner nozzle mounted in the wall of the combustion chamber. Such bends in the pipe often create unevenness in the previously-diffused flow at the critical moment prior to combustion, an unevenness that cannot be fully compensated by splitter plates in the nozzle. One approach to solving this problem has been to place diffuser structure in the pipe between the elbow and the burner nozzle, as shown for example in co-pending application Ser. No. 09/901,207. This typically limits the distance over which diffusion can take place, since the run of pipe from burner to nozzle is usually short, and increases the risk of creating a pressure drop just prior to the burner. Creating a pressure drop at the burner can then adversely affect the previous, upstream attempts at balancing flow through the pipes to the burners. And the placement of diffuser structure in the pipe next to the burner can make it difficult to access the burner through the pipe for frequently needed inspection and repair.

BRIEF SUMMARY OF THE INVENTION

The present invention is a multi-directional, multi-layer diffuser structure adapted to be inserted as a unit into a pipe, in particular in the short run of pipe between an elbow and the burner nozzle, but useful elsewhere as well. The unitary nature of the diffuser insert simplifies the tasks of installing and removing the diffuser structure from the pipe.

The diffuser structure comprises a number of vertical, wall-mounted diffuser bars and one or more ring diffuser elements secured between the bars. The diffuser bars include steps of different radial dimension to define multi-point shelves spaced along the length of the bars for mounting ring elements of different diameter. While the diffuser rings themselves can provide a sufficient structural connection between the vertical bars to form a unitary insert, a venturi inlet cap is preferred to further strengthen the connection and to provide a rapid diffusion effect at the inlet of the diffuser while minimizing pressure drop. The resulting unitary insert can be inserted axially into the open end of a pipe section for convenient installation, in a preferred form secured to the inside of the pipe with a pipe-shaped seal/retaining portion on the accessible end of the inlet cap.

Although the diffuser insert can be installed in any section of pipe before or after the pipe section is installed, pipe access structure formed in the elbow section of pipe can be used to conveniently place the inventive diffuser insert in piping adjacent the elbow. The access structure is typically a removable back-plate that exposes an opening axially aligned with the adjacent section of pipe. The diffuser insert can be inserted axially through the back of the elbow into the appropriate section of pipe and secured in place. The back-plate is easily reinstalled to seal the pipe.

Another aspect of the invention is a smooth-edged vertical diffuser element used in the diffuser insert to eliminate "roping", a form of uneven coal distribution in which a dense, rope-like distribution of coal spirals down the pipe in an erratic fashion, often hugging the pipe wall. The smooth-edged vertical element effectively counteracts roping without adding significantly to pressure drop through the diffuser insert.

These and other feature and advantages of the invention will become apparent upon further reading of the specification, in light of the accompanying drawings.

DETAILED DESCRIPTION OF THE INVENTION

Figure 1:
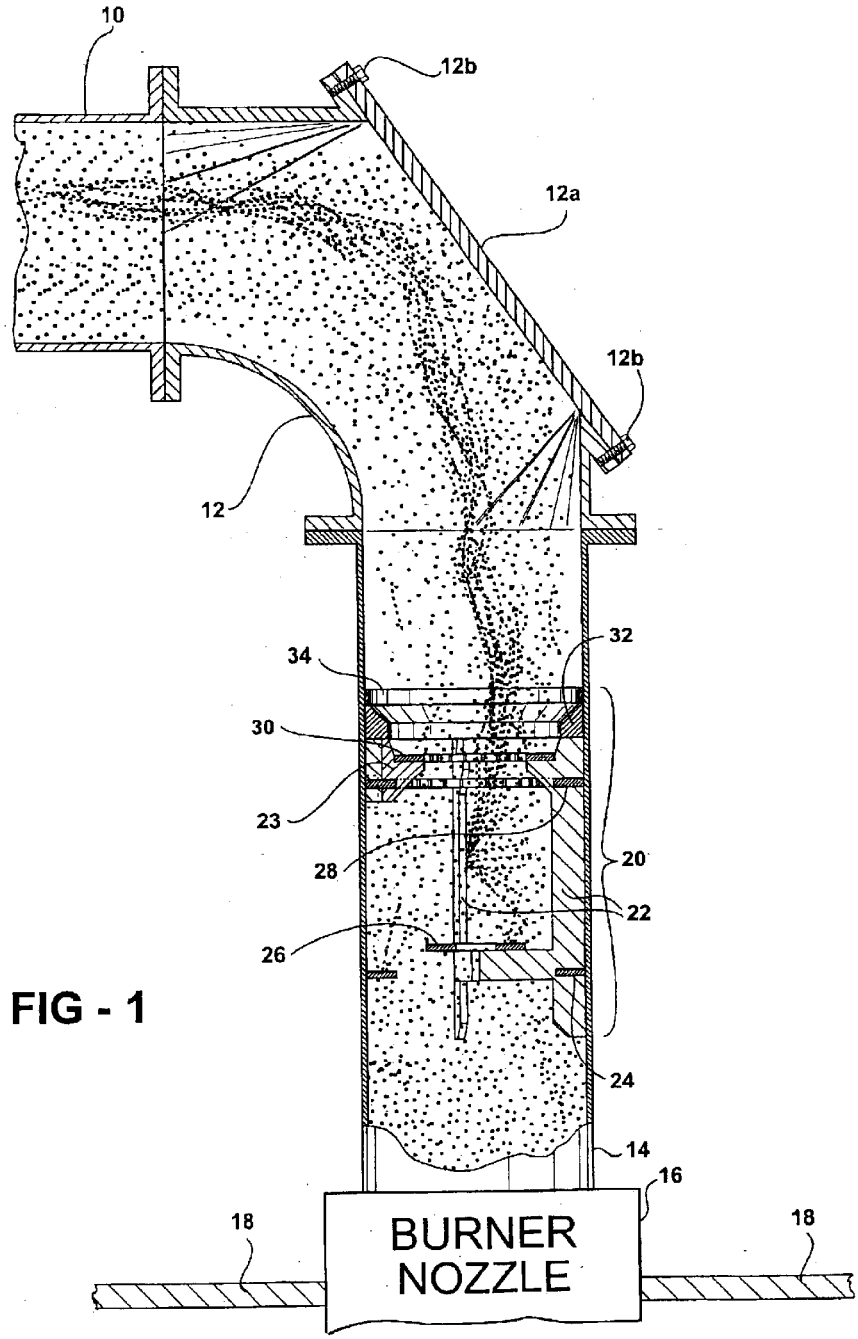
FIG. 1 is a side elevation view, in partial section, of a coal delivery pipe just prior to a burner nozzle mounted in the wall of a coal-fired combustion chamber, with an elbow section and a diffuser structure according to the invention.

Referring first to FIG. 1, a pipe 10 delivers a flow of pulverized coal and air from a source of pulverized coal such as a pulverizer/classifier (not shown) to a burner nozzle 16 mounted in the wall of a combustion chamber 18. The end of pipe 10 is re-routed into alignment with burner nozzle 16 in common fashion, using an elbow pipe section 12 and a short length of connector pipe 14 between the elbow and the burner nozzle. This general arrangement of piped coal supply from a classifier to a combustion chamber is well known, and the specifics of burner nozzle, combustion chamber, piping, and classifier can vary as is known to those skilled in the art.

As noted above, the typical combustion chamber is supplied with many burner nozzles, for example from two to twelve. Attempts are usually made upstream, sometimes beginning at the classifier itself, to ensure that the flow of pulverized coal is evenly balanced among the burners. Once the coal reaches the burner nozzles, the nozzles themselves are often designed to redistribute the coal flowing through them so that the flow exiting each nozzle is provided in an even pattern to the combustion chamber fireball. But the sharply-angled elbow 12 in the piping just before the burner nozzle often interferes with both of these objectives by tending to encourage "roping" of coal concentrations against the walls of the pipe and into the nozzles.

The present invention addresses this problem by placing a diffuser structure 20 in the short run of connector pipe 14 between elbow 12 and the burner nozzle. Roping is a phenomenon that tends to occur over relatively long stretches of pipe, although it may be triggered, encouraged, or exacerbated at discrete locations in the piping such as elbow 12. To the extent that roping is present between elbow 12 and nozzle 16, diffuser 20 breaks it up, along with any other unevenly distributed flow components over the short, straight path from the outlet end of the elbow to nozzle 16.

Diffuser structure 20 is a combination of vertical anti-roping bars 22 and horizontal diffuser rings 24, 26, 28, 30 that addresses both the swirling, radial component of roped concentrations, especially against the inside wall of the pipe, and the axial component of roped or otherwise uneven distribution patterns traveling through the pipe. Additionally, diffuser 20 has an inlet "cap" or ring 32 creating a venturi nozzle diffusion effect at the diffuser inlet with minimal pressure drop. Pressure drop does occur through the venturi inlet, but is less than would occur with a restrictor or collision type diffuser element at that point, and the venturi-style diffusion at the inlet is believed to mitigate pressure loss through the downstream portions of the diffuser as the coal flow encounters the diffuser bars and rings.

Figure 1A:
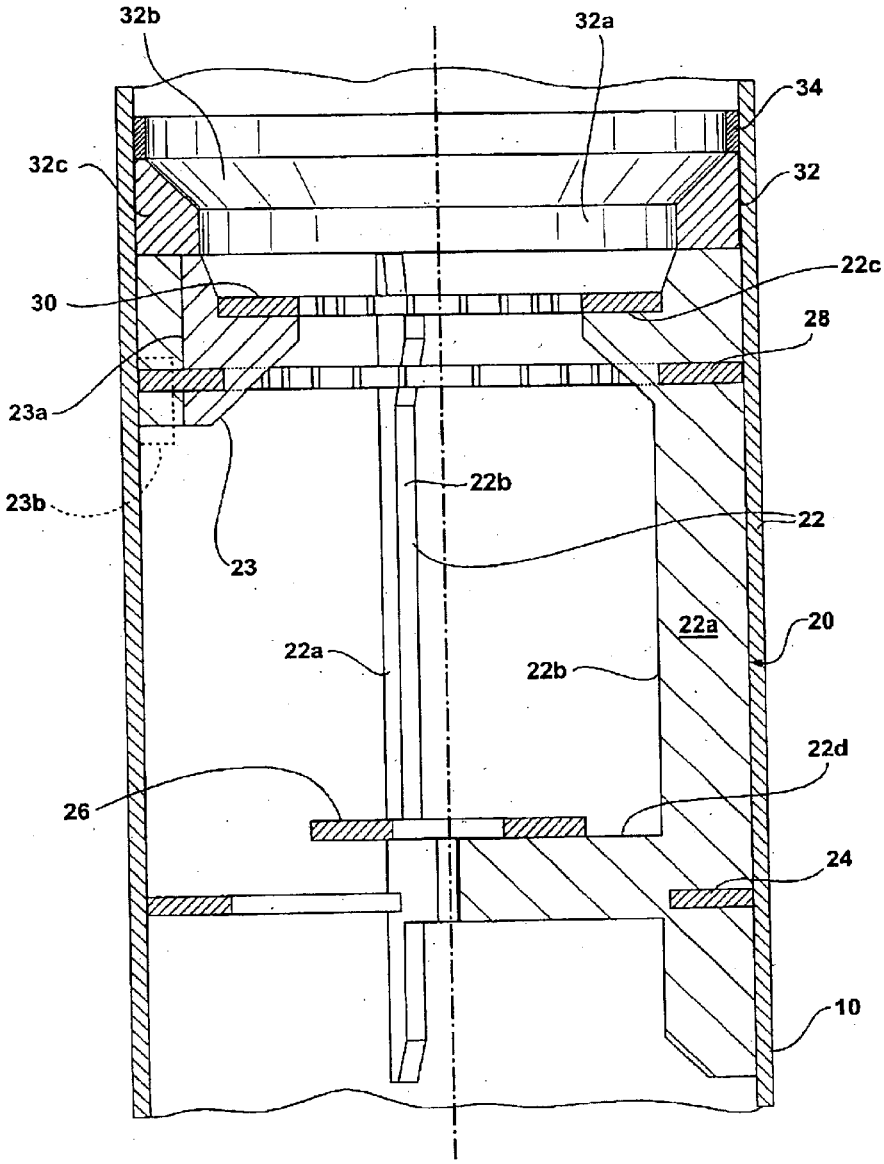
FIG. 1A is a detailed side elevation view of the diffuser structure of FIG. 1.

In the example of FIG. 1, vertical diffuser bars 22 are elongated steel members arranged axially ("vertically") on the interior surface of the pipe wall in line with the overall direction of flow through the pipe, i.e. generally aligned with the pipe axis. The illustrated example shows three diffuser bars 22, which provide a stable, three-point base or structural skeleton for diffuser rings 24–30. As best shown in FIG. 1A, each diffuser bar 22 is characterized by flat faces 22*a* and a smooth anti-roping edge 22*b* projecting laterally into the interior volume of the pipe from the wall, so as to be essentially perpendicular to radial components of flow in the pipe. Upper and lower ends of bars 22 include radial "shelves" 22*c* and 22*d*, respectively, projecting inwardly beyond edges 22*b* to provide supports for rings 24–30. Shelves 22*c* and 22*d* also present lateral faces to radial components of the flow, but do so inwardly of faces 22*a* and edge 22*b* in order to disrupt the radial component of concentrations of coal located inwardly of the pipe wall. Lower (downstream) shelves 22*d* extend further inwardly than upper shelves 22*c*, in the illustrated embodiment meeting at the center of the insert.

Figure 2:
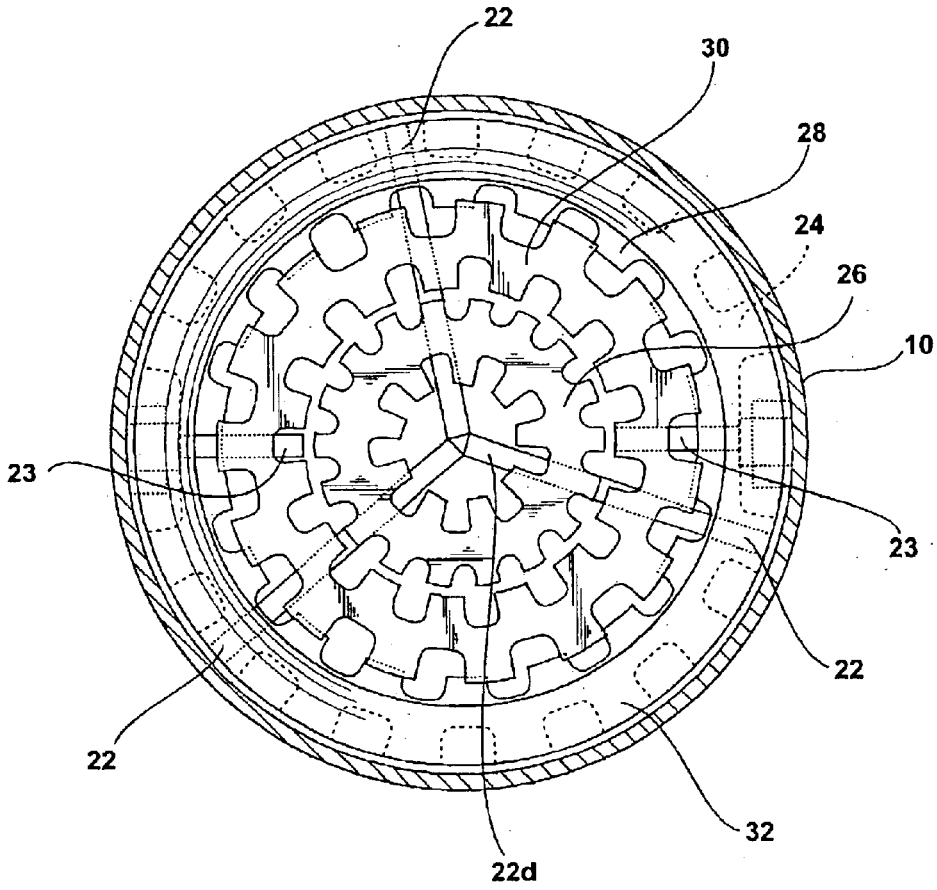
FIG. 2 is a top plan view of the diffuser structure of FIG. 1.
Figure 3:
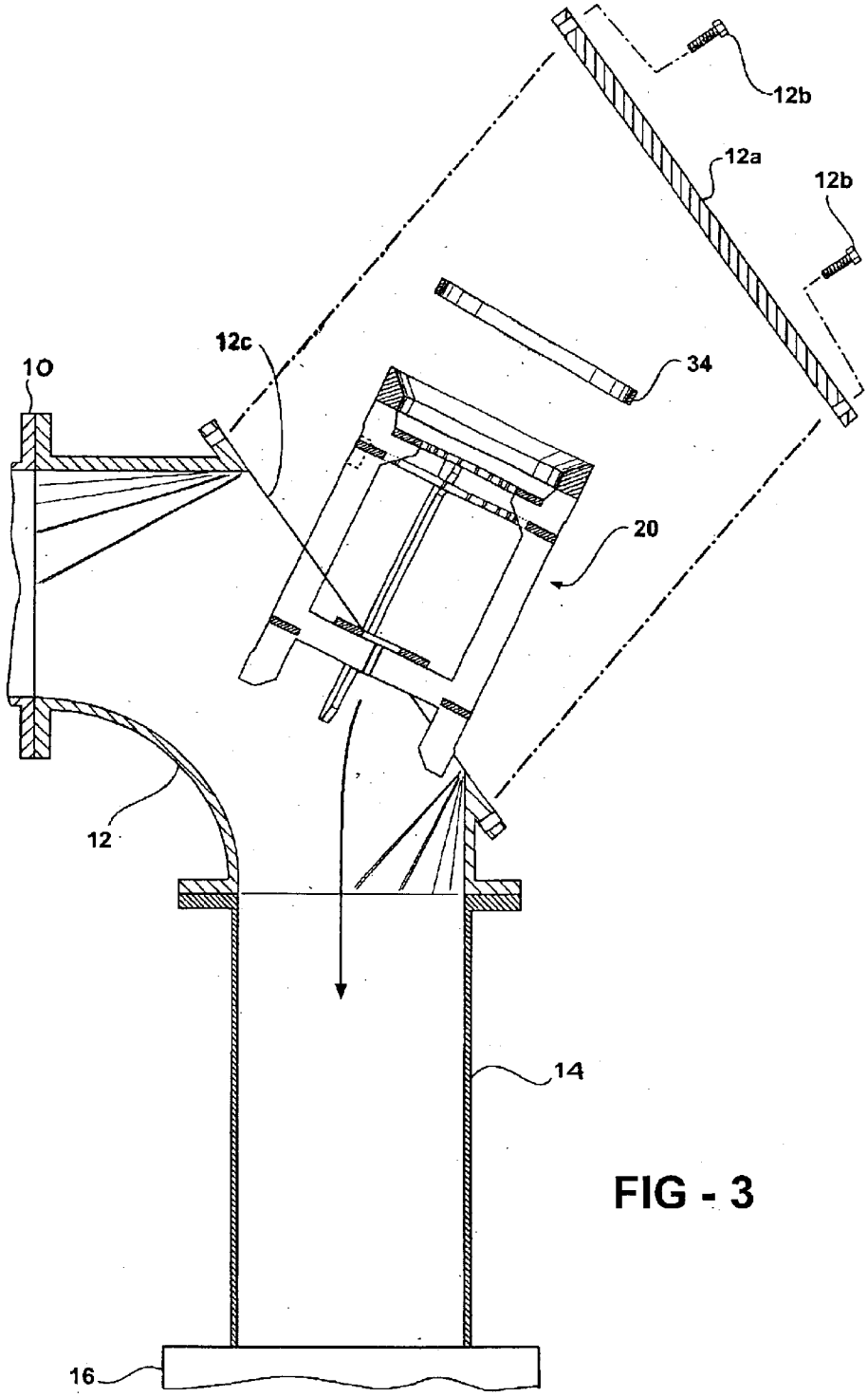
FIG. 3 shows the elbow of FIG. 1 opened for the insertion of the diffuser insert.

Diffuser rings 24–30 in the illustrated embodiment are steel rings with flat faces placed generally orthogonal to axial flow through the pipe to disrupt and diffuse axial components of any coal concentrations or ropes. The rings are spaced apart vertically, and are toothed or serrated along their inner and/or outer edges, as best shown in FIG. 2, to optimize diffusion while minimizing pressure drop that occurs when the axial flow area through the pipe-shaped insert is restricted. The illustrated example shows multiple rings 24, 26, 28, and 30 spaced vertically along bars 22. At least some of the rings are of different diameter, while any rings of equal diameter are separated by rings of different diameter and/or have staggered, non-aligned orientations of their respective teeth.

Additional short vertical tabs or supports 23 may be added to the array of diffuser bars 22 between bars 22, for example as extra points of attachment to the inside wall of the pipe, and/or to provide a supplemental radial diffusion function between bars 22.

Inlet cap 32 is a continuous, smooth surfaced, relatively thick-walled ring at the upper or inlet end of diffuser 20, secured to the upper ends of bars 22 and having a converging nozzle portion 32*b* and a narrower cylindrical throat portion 32*a*. Inlet cap 32 provides an initial venturi type diffusion of the coal flow as it enters diffuser structure 20.

The above-described portions of diffuser 20 are assembled as a unitary insert for a given size and shape of pipe, for example by welding the bars 22, rings 24–30, and cap 32 to one another as shown, prior to installing the diffuser in pipe 10.

Referring to FIGS. 1 and 2, a cover or backplate 12*a* is located on the outside surface of pipe elbow 12 in known manner. Backplate 12*a* is a section of pipe material removably secured (for example with bolts 12*b*) in a sealing fit over an opening 12*c* formed on the outside surface or radius of pipe 12 by removing a planar segment of the pipe wall. Pipe 12 may be originally manufactured with backplate access 12*a*, or may be modified afterward, even, for example, while it remains connected in-line with piping 10 and burner nozzle 16. The manner of securing and sealing such backplates to the back of the pipe elbow can vary.

Opening 12*c* is preferably large enough to be axially aligned with the area of connector pipe 14 between elbow 12 and nozzle 16. This allows diffuser 20, prefabricated as a one-piece, drop-in insert, to be inserted axially into pipe 14 through opening 12*c* when the backplate is removed. Once inserted, diffuser 20 is secured in place with known techniques, the preferred one being welding. In the illustrated embodiment, the drop-in diffuser insert 20 is secured at its inlet end (cap 32) with a novel retaining ring 34 comprising a thin-walled weldable metal ring that fits flush on the upper edge of cap 32 and is welded to the cap and against the inside surface of the pipe. Retaining ring 34 is preferably sealed at its interface with cap 32, for example with an RTV sealant of known type for high temperature applications.

Uneven distributions of coal flow entering diffuser 20 are subjected to several different diffusing actions over a relatively short distance: venturi-type diffusion at the inlet; radial/anti-roping diffusion as radial components of flow not fully diffused by the venturi inlet encounter anti-roping bars 22; and axial diffusion as axial components of flow not fully diffused by the venturi inlet encounter the axial diffuser rings 24–30. It should be noted that the diffuser ring 30 nearest inlet 32 is sized with an outer diameter equal to or smaller than throat 32*a*.

The coal flow that has passed through diffuser 20 and elbow 12 is accordingly thoroughly diffused, and thus reaches nozzle 16 in an evenly distributed state. Roping between the elbow and the burner nozzle is eliminated, and is discouraged from occurring upstream. With diffuser 20 inserted and fastened in place as a unit at retaining ring 34, and with axial pipe access through backplate 12*a*, the diffuser's axial position in the pipe relative to the elbow is easily adjusted by opening up the elbow, dislodging the retaining ring connection from the pipe, shifting diffuser 20 to a different position in pipe 10, refastening the retaining ring, and closing the elbow. Removal of diffuser 20 from the pipe for maintenance or repair of the insert or nozzle is likewise simplified.

It will be apparent to those skilled in the art that although a preferred example of the invention is disclosed herein for purposes of explanation, various features may be modified according to different pipe and burner environments, and in the details of manufacture and installation. The invention accordingly is not to be limited to the example shown herein, but is defined by the following claims.

What is claimed is:

1. In a coal delivery system comprising a delivery pipe from a pulverized coal source to the burner nozzle of a combustion chamber, the pipe being connected to the burner nozzle through an elbow portion adjacent the nozzle, a diffuser comprising:

a diffuser structure in the pipe between the elbow and the nozzle, the diffuser structure comprising a combination of radial and axial diffusion elements for engaging and diffusing radial and axial portions of coal concentrations flowing through the pipe, and a venturi inlet upstream of the radial and axial diffusion elements;

wherein the radial diffusion elements comprise a plurality of radially-spaced vertical diffuser bars extending from the venturi inlet and arranged axially along the inside wall of the pine, and the axial diffusion elements comprise a plurality of diffuser rings arranged radially between and spaced axially along the vertical diffuser bars.

2. The diffuser of claim 1, wherein the diffuser structure is formed as an axial insert for the pipe.

3. The diffuser of claim 2, wherein the venturi inlet includes an inlet-end portion secured directly to an inside wall of the pipe.

4. The diffuser of claim 3, wherein the diffuser includes a retaining ring secured to the inlet end of the venturi inlet, and the retaining ring is secured to the inside of the pipe.

5. The diffuser of claim 1, wherein a diffuser ring nearest the inlet has a diameter equal to or less than the diameter of a throat portion of the venturi inlet.

6. The diffuser of claim 1, wherein the vertical diffuser bars include shelf portions projecting radially inwardly from the bars and supporting one or more of the diffuser rings.

7. A diffuser insert for a coal delivery pipe in a coal delivery network between a source of pulverized coal and a burner nozzle for a combustion chamber, the insert comprising:

a venturi inlet having a smooth converging surface and a throat;

a plurality of spaced radial diffuser elements extending vertically from the inlet, the vertically extending radial diffuser elements being spaced circumferentially around the inlet to define a pipe-shaped diffusion volume between them for a given pipe, the radial diffuser elements adapted to lie axially along the inside wall of the given pipe when the insert is inserted in the given pipe;

a plurality of axial diffuser elements comprising flat rings supported at spaced axial locations between the radial diffuser elements.

8. The diffuser insert of claim 7, wherein the radial diffuser elements include supports extending radially inwardly into the diffusion volume, at least one of the ring-shaped axial diffuser elements being supported on the supports.

* * * * *